US007877921B1

(12) United States Patent
Stenton

(10) Patent No.: US 7,877,921 B1
(45) Date of Patent: Feb. 1, 2011

(54) METHOD AND APPARATUS FOR COMBINING LIGHT FROM TWO SOURCES TO ILLUMINATE A RETICLE

(75) Inventor: William Conrad Stenton, Midland (CA)

(73) Assignee: Raytheon Company, El Segundo, CA (US)

( * ) Notice: Subject to any disclaimer, the term of this patent is extended or adjusted under 35 U.S.C. 154(b) by 880 days.

(21) Appl. No.: 11/368,855

(22) Filed: Mar. 6, 2006

(51) Int. Cl.
*F41G 1/38* (2006.01)

(52) U.S. Cl. ..... 42/123; 42/131

(58) Field of Classification Search ..... 42/122, 42/119, 123, 130, 132; 385/147; 33/297
See application file for complete search history.

(56) References Cited

U.S. PATENT DOCUMENTS 3,121,163 A 2/1964 Rickert
3,514,184 A 5/1970 Vogl
3,552,819 A 1/1971 Mandler
4,199,376 A 4/1980 Sill
4,391,269 A 7/1983 Watson
4,645,975 A 2/1987 Meitzler et al.
4,710,636 A 12/1987 Martino
4,743,765 A 5/1988 Ekstrand
4,806,007 A 2/1989 Bindon
4,981,331 A 1/1991 Taylor
5,065,520 A 11/1991 Shimizu et al.
5,434,704 A * 7/1995 Connors et al. ..... 359/403
5,456,035 A * 10/1995 Stiles ..... 42/120
5,653,034 A 8/1997 Bindon
5,771,623 A * 6/1998 Pernstich et al. ..... 42/115
5,924,234 A 7/1999 Bindon
6,031,604 A * 2/2000 Pniel ..... 356/124
6,313,943 B1 11/2001 Ikado et al.
6,721,095 B2 * 4/2004 Huber ..... 359/427
6,807,742 B2 * 10/2004 Schick et al. ..... 33/297
7,428,796 B1 * 9/2008 Stenton et al. ..... 42/123
2002/0007111 A1 1/2002 Deckert et al.
2002/0062856 A1 5/2002 Wescott
2003/0086165 A1 5/2003 Cross et al.
2004/0047586 A1 * 3/2004 Schick et al. ..... 385/147
2004/0201886 A1 * 10/2004 Skinner et al. ..... 359/399

(Continued)

OTHER PUBLICATIONS

U.S. Appl. No. 11/368,850, filed Mar. 6, 2006 by inventors William Conrad Stenton and Brien D. Ross for "Method and Apparatus for Using a Lens to Enhance Illumination of a Reticle", 19 pages of text, 4 pages of drawings.

(Continued)

*Primary Examiner*—Michael J Carone
*Assistant Examiner*—Samir Abdosh
(74) *Attorney, Agent, or Firm*—Haynes and Boone LLP

(57) ABSTRACT

A weapon sight has an optical system that causes first radiation to propagate along a path of travel within the sight, and has a reticle generating portion that causes second radiation representing a reticle to propagate along the path of travel with the first radiation. The reticle generating portion includes a reticle illuminating portion that illuminates the reticle. The reticle illuminating portion includes a first light source having thereon a surface, light from the first light source passing through the surface and then illuminating the reticle. The reticle illuminating portion also includes a second light source spaced from the first light source, light from the second light source traveling toward the surface, being reflected and then illuminating the reticle.

17 Claims, 4 Drawing Sheets

U.S. PATENT DOCUMENTS

| | | | | |
|---|---|---|---|---|
| 2005/0252062 | A1 * | 11/2005 | Scrogin et al. | 42/119 |
| 2006/0231133 | A1 | 10/2006 | Fork et al. | |

OTHER PUBLICATIONS

U.S. Appl. No. 11/497,902, filed Aug. 1, 2006 by inventor William Conrad Stenton for "Method and Apparatus for Efficiently Collecting Radiation", 22 pages of text, 3 pages of drawings.

U.S. Appl. No. 11/923,129, filed Oct. 24, 2007 by inventor William Conrad Stenton for "Method and Apparatus for Illuminating a Reticle", 15 pages of text, 2pages of drawings.

Notice of Allowance mailed Apr. 8, 2008 in U.S. Appl. No. 11/368,850, filed Mar. 6, 2006.

Office Action mailed Jun. 2, 2009 in U.S. Appl. No. 11/923,129, filed Oct. 24, 2007.

* cited by examiner

TRITIUM
LIGHT
SOURCE
51
112
28
116
111
151
117
31
32
LED
114

TRITIUM
LIGHT
SOURCE
51
112
116
111
151
117
28
31
32
181

METHOD AND APPARATUS FOR COMBINING LIGHT FROM TWO SOURCES TO ILLUMINATE A RETICLE

TECHNICAL FIELD OF THE INVENTION

This invention relates in general to weapon sights and, more particularly, to techniques for illuminating a reticle in a weapon sight.

BACKGROUND OF THE INVENTION

Over the years, various techniques have been developed to help a person accurately aim a weapon such as a rifle. One common approach is to mount a sight or scope on the weapon. A person then uses the sight or scope to view an image of a scene that includes an intended target. Existing sights typically impose a reticle on the image of the scene. For example, the reticle may be in the form of crosshairs.

Under certain circumstances, it may be advantageous if the reticle is illuminated. Various techniques have previously been developed for illuminating a reticle. Although these known techniques have been generally adequate for their intended purposes, they have not been satisfactory in all respects.

SUMMARY OF THE INVENTION

One of the broader forms of the invention involves: causing first radiation to propagate along a path of travel within a weapon sight; causing second radiation representing a reticle to propagate along the path of travel with the first radiation; causing light from a first light source to pass through a surface of the first light source and to then illuminate the reticle; and causing light from a second light source spaced from the first light source to travel toward the surface, to be reflected, and to then illuminate the reticle

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
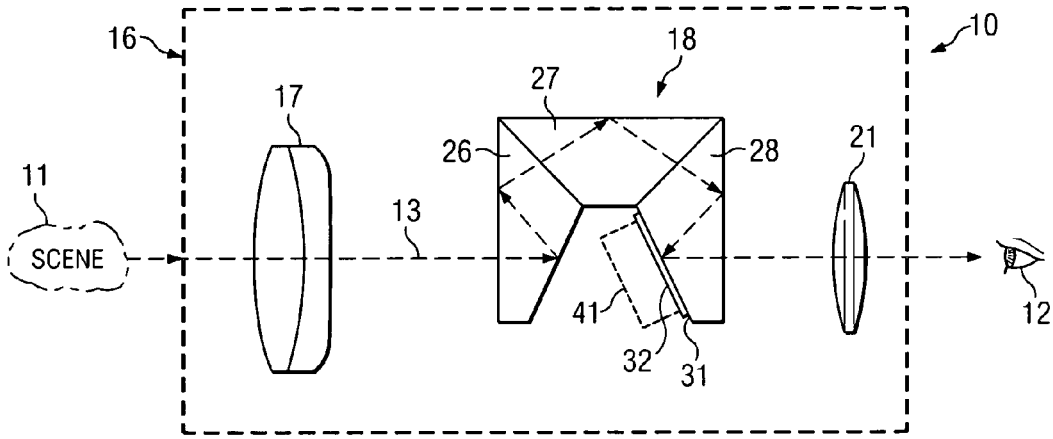
FIG. 1 is a diagrammatic view of an apparatus that is an optical sight for a weapon, and that embodies aspects of the present invention.

FIG. 1 is a diagrammatic view of an apparatus that is an optical sight 10, and that embodies aspects of the present invention. The sight 10 is designed to be mounted on a not-illustrated weapon, such as a rifle or pistol. A person uses the sight 10 to accurately aim the weapon. In particular, radiation from a remote scene 11 travels through the sight 10 along a path of travel 13 to the eye 12 of the person who is using the sight.

The sight 10 has a housing that is represented diagrammatically in FIG. 1 by a broken line 16. An optical system is provided within the housing 16, and includes an objective lens 17, a prism assembly 18, and an eyepiece lens 21. Radiation from the scene 11 that is traveling along the path of travel 13 passes successively through the objective lens 17, prism assembly 18, and eyepiece lens 21. The prism assembly 18 is a configuration of a known type, and includes three prisms 26, 27, and 28. The prism assembly 18 includes several prism surfaces that reflect the radiation as it travels through the prism assembly 18 along the path of travel 13. One of these surfaces is identified by reference numeral 31 in FIG. 1.

An optical coating 32 of a known type is provided on the prism surface 31. The coating 32 is reflective to visible radiation that is traveling along the path of travel 13. In a known manner, the coating 32 has at least one not-illustrated opening etched through it, in the shape of a reticle. For example, the reticle may have the form of crosshairs of a known type. The sight 10 further includes a reticle illuminating portion 41, which is represented diagrammatically in FIG. 1 by a broken line. Preexisting sights have a reticle illuminating portion that is simply a light source located behind the optical coating 32. Light from the known light source impinges on the rear side of the optical coating 32, and part of this radiation passes through the openings in the coating 32 that define the reticle. But in the disclosed embodiment of FIG. 1, the reticle illuminating portion 41 is different.

Figure 2:
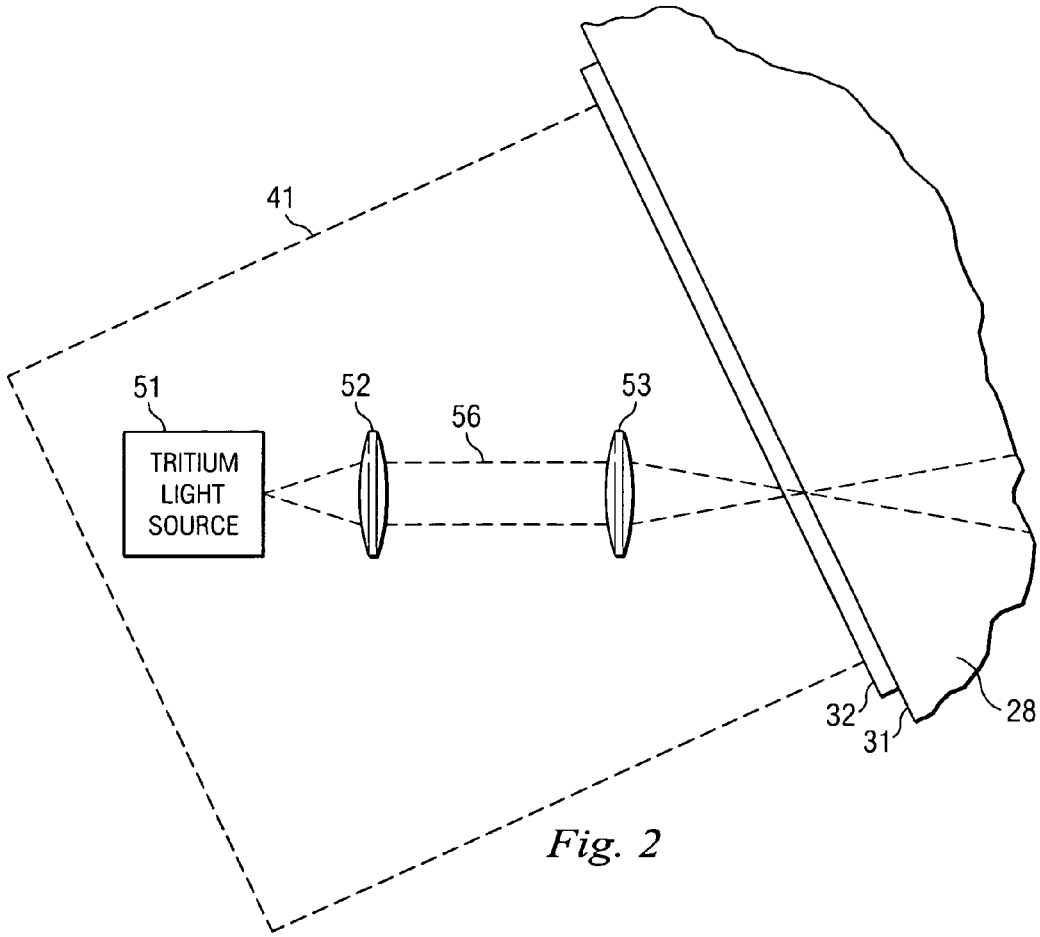
FIG. 2 is a diagrammatic view showing a portion of the sight of FIG. 1 in an enlarged scale.

More specifically, FIG. 2 is a diagrammatic view showing a portion of FIG. 1 in an enlarged scale, including a portion of the prism 28, a portion of the coating 32, and the internal structure of the reticle illuminating portion 41. As shown in FIG. 2, the reticle illuminating portion 41 includes a tritium light source 51. In FIG. 2, the tritium light source 51 is a radioluminescent capsule of a type known in the art. More specifically, tritium is a radioactive isotope of hydrogen with atoms having three times the mass of ordinary light hydrogen atoms. The tritium material is provided within a capsule that is made from glass or some other suitable material, and that has a phosphor coating on its inner surface. As the tritium material decays, it emits soft beta rays that, when they strike the phosphor coating, are converted to visible light. The half life of tritium is approximately 12.5 years, and thus the tritium light source 51 has a usable life of more than 15 years. Consequently, the tritium light source glows continuously for a long time, thereby providing a safe and reliable source of light, without any need for a power source such as a battery.

The reticle illuminating portion 41 also includes two small lenses 52 and 53. Light 56 emitted by the tritium light source 51 passes successively through the lenses 52 and 53 toward the coating 32, and some of this radiation then passes through the not-illustrated openings in coating 32 that define the reticle. In the disclosed embodiment, the lens 52 has a relatively short focal length, so that it collects light over a large solid angle. Stated differently, the lens 52 has a high numerical aperture (NA). The radiation traveling away from the lens 52 is collimated, or in other words is projected to infinity. This collimated radiation is collected by the lens 53. The lens 53 has a focal length selected so that it collects all the energy from the lens 52, and converts this energy into a solid angle that matches the eyepiece optics 21 (FIG. 1). Since this solid angle is smaller than the solid angle used for collection by the lens 52, the lenses 52 and 53 collectively provide an increase in brightness of the illumination of the reticle at the coating 32, in comparison to the brightness that would be realized if the lenses 52 and 53 were not present.

In FIG. 1, the objective lens 17, prism assembly 18 and the eyepiece lens 21 represent a simple and exemplary optical system. The reticle illuminating portion 41 of FIG. 2 can be used not only in the optical system of FIG. 1, but also in a variety of other optical systems.

Figure 3:
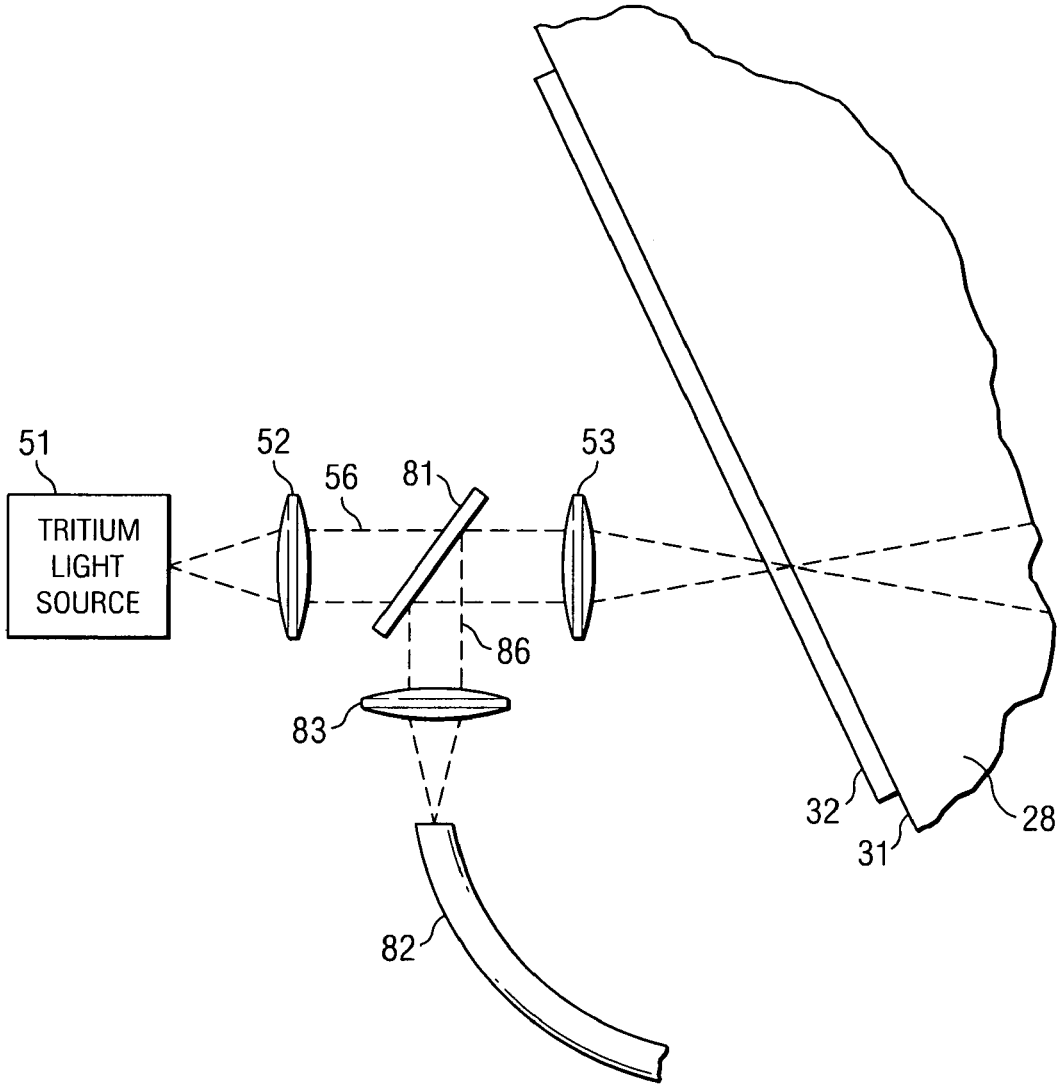
FIG. 3 is a diagrammatic view showing a configuration that is an alternative embodiment of the configuration shown in FIG. 2.

FIG. 3 is a diagrammatic view showing a configuration for reticle illumination that is an alternative embodiment of the configuration shown in FIG. 2. The embodiment of FIG. 3 includes all of the elements shown in FIG. 2, as well as some additional elements. The following discussion focuses primarily on the additional elements. In particular, a beam splitter of a known type is disposed optically between the lenses 52 and 53. The beam splitter is transmissive to radiation having one wavelength or color, and is reflective to radiation at a different wavelength or color. In FIG. 3, the radiation 56 from the tritium light source 51 passes through the beam splitter 81 as it travels from the lens 52 to the lens 53.

The embodiment of FIG. 3 includes a fluorescent fiber 82 of a known type. As known in the art, the fiber 82 has a core that is made from a material such as polystyrene, and that is surrounded by a cladding made from a material such as a clear acrylic. The core is doped with a special fluorescent dye. Ultraviolet light can pass through the cladding and into the core, where the fluorescent dye absorbs the ultraviolet light and then emits visible light. The material of the dye determines the color of the visible light that is produced. Due to differences in the refractive indexes of the cladding and core, the visible light is trapped within the core, and is reflected to the ends of the fiber 82.

The fiber 82 has a distal end that is not visible in FIG. 3, and that is disposed externally of the weapon sight 10. The distal end of the fiber 82 can pick up ultraviolet light from sources such as sunlight, when the ambient light around the sight includes ultraviolet light. When this ultraviolet light enters the distal end of the fiber 82, it generates visible light in the manner discussed above. The visible light then travels through the fiber 82 to the illustrated end, where it is emitted from the fiber.

A small lens 83 is provided between the beam splitter 81 and the illustrated end of the fiber 82. Visible light emitted from the end of the fiber 82 passes through the lens 83, travels at 86 to the beam splitter 81, is reflected by the beam splitter 81, travels to and passes through the lens 53, and then propagates toward the coating 32. The lens 83 is selected to maximize the coupling efficiency between the numerical aperture (NA) of the fiber 82 and the numerical aperture of the eyepiece optics. The lens 83 is similar to the lens 52, in that it has a relatively high numerical aperture, or in other words a very short focal length, so that it can collect light over a large solid angle. The lens 53 converts that radiation into a solid angle that is smaller than the solid angle used for collection by the lens 83. Thus, as seen by the coating 32, the lenses 83 and 53 collectively provide an increase in brightness of the light emitted from the end of the fiber 82, in comparison to the brightness that would be realized if the lenses 83 and 53 were not present.

When the weapon sight 10 is in an environment where the ambient light includes sunlight or some other source of ultraviolet radiation, the visible light emitted from the fiber 82 is significantly brighter than the light emitted by the tritium light source 51. Thus, in this type of situation, the illumination of the reticle is effected primarily by the light produced by the fluorescent fiber 82. In contrast, when the weapon sight 10 is being used in darkness or some other environment that has little or no ultraviolet light, the fiber 82 will be emitting little or no visible light, but the tritium light source 51 will still be active and will provide suitable illumination for the reticle.

In FIG. 3, the tritium light source 51 and the fiber 82 are selected so they produce light with different colors, and thus different wavelengths. The beam splitter 81 is designed to transmit substantially all light at the wavelength of the tritium light source 51, and to reflect substantially all light at the wavelength of the fiber 82. Alternatively, however, the tritium light source 51 and the fiber 82 could be selected so that they produce light at substantially the same wavelength and color, and the beam splitter 81 could be selected so that it transmits approximately half of the light at this wavelength and reflects approximately half of the light at this wavelength. Of course, this latter approach is less efficient than the former in terms of how much radiation from either source will ultimately reach the coating 32.

Figure 4:
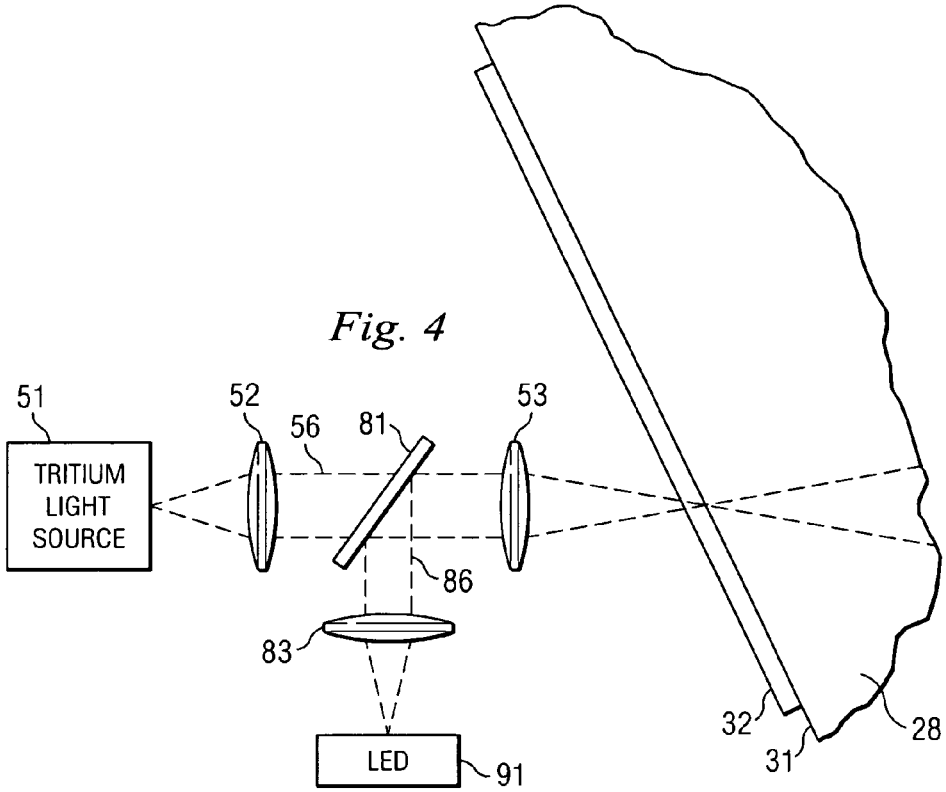
FIG. 4 is a diagrammatic view of a configuration that is an alternative embodiment of the configuration shown in FIG. 3.

FIG. 4 is a diagrammatic view of a configuration that is an alternative embodiment of the configuration shown in FIG. 3. FIG. 4 is identical to FIG. 3, except that the fluorescent fiber 82 of FIG. 3 has been replaced with a light emitting diode (LED) 91. The LED 91 is powered by a not-illustrated battery within the weapon sight 10, and a not-illustrated manual switch would typically be provided in series with the battery. The switch can be manually operated so that the LED 91 is selectively turned on and off. The operation of the embodiment of FIG. 4 is similar to the operation of the embodiment of FIG. 3, and is therefore not described in detail here.

Figure 5:
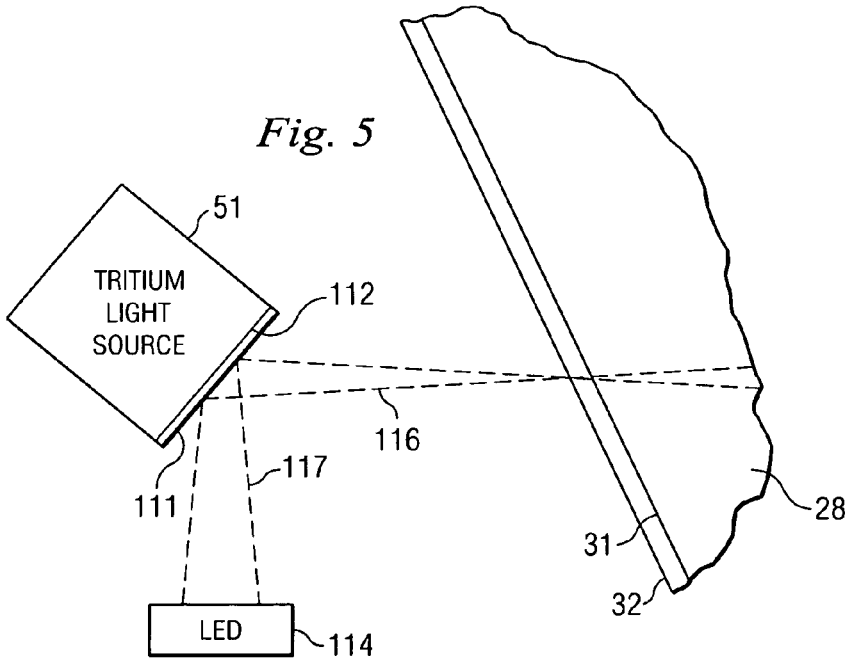
FIG. 5 is a diagrammatic view of a configuration that is yet another alternative embodiment.

FIG. 5 is a diagrammatic view of configuration that is yet another alternative embodiment. In FIG. 5, the tritium light source 51 has a relatively flat surface 112 with an optical coating 111 thereon. An LED 114 is provided at a location spaced from the tritium light source 51. Light from the tritium light source 51 passes through the surface 112 and the optical coating 111, and travels at 116 toward the coating 32 on the prism surface 31. Light from the LED 114 travels at 117 to the coating 111, where it is reflected and then travels at 116 toward the coating 32. The tritium light source 51 is oriented so as to place the surface 112 and the coating 111 at an angle that will cause light from the LED 114 to be reflected in a direction toward the coating 32. A not-illustrated battery and a not-illustrated manual switch are coupled in series with the LED 114.

In FIG. 5, the tritium light source 51 and the LED 114 produce light at different wavelengths, and the coating 111 is configured to transmit light at the wavelength of the tritium light source 51, and to reflect, light at the wavelength of the LED 114. Alternatively, however, the tritium source light 51 and the LED 114 could produce light at approximately the same wavelength, and the optical coating 111 could be configured so that approximately half of the light at this wavelength is transmitted and the other half is reflected. In another alternative configuration, the optical coating 111 could be omitted, such that light from the LED 114 is reflected directly by the surface 112 on the tritium light source 51. However, the provision of the optical coating 111 provides a higher degree of efficiency in reflecting light emitted by the LED 114.

Figure 6:
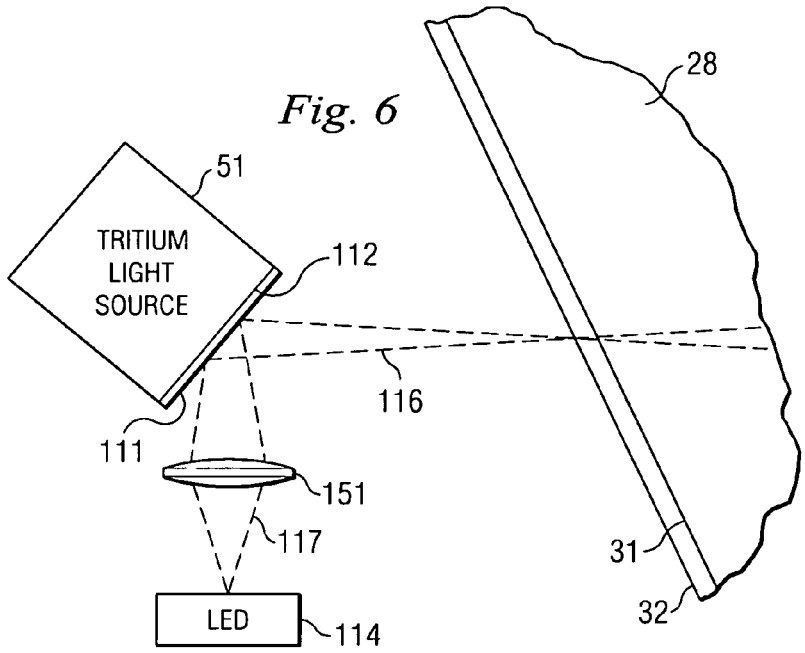
FIG. 6 is a diagrammatic view of a configuration that is an alternative embodiment of the configuration of FIG. 5.

FIG. 6 is a diagrammatic view of a configuration that is an alternative embodiment of the configuration of FIG. 5. The only difference between FIGS. 5 and 6 is that, in FIG. 6, a lens 151 has been added between the LED 114 and the optical coating 111. The lens 114 has a numerical aperture (NA) that is selected to match the numerical aperture of the eyepiece optics, and serves to increase the efficiency with which radiation from the LED 114 is utilized in illuminating the reticle.

Figure 7:
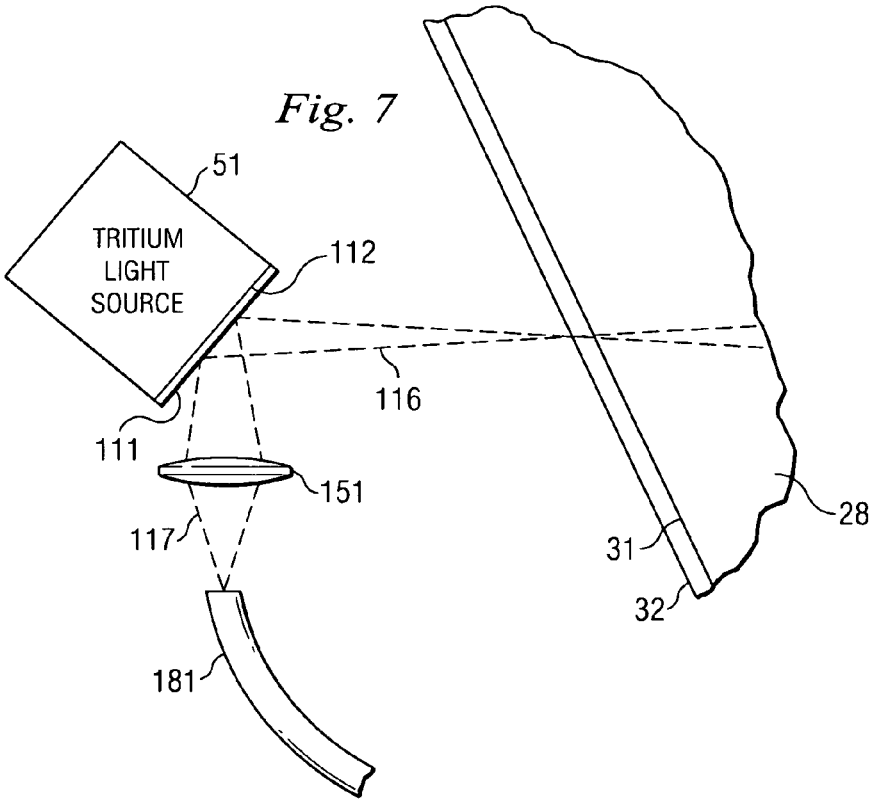
FIG. 7 is a diagrammatic view of still another configuration, which in an alternative embodiment of the configuration shown in FIG. 6.

FIG. 7 is a diagrammatic view of still another configuration, which in an alternative embodiment of the configuration shown in FIG. 6. The only difference between FIGS. 6 and 7 is that the LED 114 of FIG. 6 has been replaced with an optical fiber 181. The optical fiber 181 is equivalent to the optical fiber 82 that was discussed above in association with FIG. 3. Visible radiation emitted 117 by optical fiber 181 passes through the lens 181 on its way to the optical coating 111.

Although several selected embodiments have been illustrated and described in detail, it will be understood that they are exemplary, and that a variety of substitutions and alterations are possible without departing from the spirit and scope of the present invention, as defined by the following claims.

What is claimed is:

1. An apparatus comprising a weapon sight that includes:

an optical system that causes first radiation to propagate along a path of travel within said sight; and a reticle generating portion that causes second radiation representing a reticle to propagate along said path of travel with said first radiation, said reticle generating portion including a reticle illuminating portion that illuminates said reticle;

wherein said reticle illuminating portion includes a first light source that is a radioluminescent capsule, said capsule having an external surface thereon, and light from said first light source passing through said surface and then illuminating said reticle; and wherein said reticle illuminating portion includes a second light source spaced from said first light source, light from said second light source traveling toward said surface, being reflected, and then illuminating said reticle.

2. An apparatus according to claim 1, including an optical coating provided on said surface, light from said first light source passing through said surface and said optical coating, and light from said second light source being reflected by said optical coating.

3. An apparatus according to claim 1, wherein said second light source includes one of a radioluminescent capsule, a fluorescent fiber and a light emitting diode.

4. An apparatus according to claim 1, including a lens disposed optically between said second light source and said surface.

5. An apparatus according to claim 1, including a lens disposed optically between said second light source and said surface; and wherein said second light source is one of a fluorescent fiber and a light emitting diode.

6. An apparatus according to claim 1, wherein said optical system includes a prism having a surface with a coating that is reflective to the radiation traveling along said path of travel; and wherein said reticle generating portion includes an opening provided through said coating, light from each of said first and second light sources passing through said opening in said coating.

7. An apparatus comprising a weapon sight that includes:

optical means for causing first radiation to propagate along a path of travel within said sight; and reticle generating means for causing second radiation representing a reticle to propagate along said path of travel with said first radiation, said reticle generating means including reticle illuminating means for illuminating said reticle;

wherein said reticle illuminating means includes first source means for emitting light said first source means including a radioluminescent capsule, said capsule having an external surface thereon, and light from said first source means passing through said surface and then illuminating said reticle; and wherein said reticle illuminating means includes second source means for emitting light, said second source means being spaced from said first source means, and light from said second source means traveling toward said surface, being reflected, and then illuminating said reticle.

8. An apparatus according to claim 7, wherein said reticle illuminating means said surface and said optical coating, and light from said second source means being reflected by said optical coating.

9. An apparatus according to claim 7, wherein said second source means includes one of a radioluminescent capsule, a fluorescent fiber and a light emitting diode.

10. An apparatus according to claim 7, including a lens disposed optically between said second source means and said surface.

11. An apparatus according to claim 1, including a lens disposed optically between said second source means and said surface; and wherein said second source means is one of a fluorescent fiber and a light emitting diode.

12. An apparatus according to claim 7, wherein said optical means includes a prism having a surface with a coating that is reflective to the radiation traveling along said path of travel; and wherein said reticle generating means includes an opening provided through said coating, light from each of said first and second source means passing through said opening in said coating.

13. A method comprising:

causing first radiation to propagate along a path of travel within a weapon sight;

causing second radiation representing a reticle to propagate along said path of travel with said first radiation;

causing light from a first light source that is a radioluminescent capsule to pass through an external surface of said capsule and to then illuminate said reticle; and causing light from a second light source spaced from said first light source to travel toward said surface, to be reflected, and to then illuminate said reticle.

14. A method according to claim 13, including providing an optical coating on said surface of said first light source, light from said first light source passing through said surface and said coating, and light from said second light source being reflected by said optical coating.

15. A method according to claim 13, including selecting one of a radioluminescent capsule, a fluorescent fiber and a light emitting diode to serve as said second light source.

16. A method according to claim 13, including causing light from said second light source to pass through a lens before reaching said surface.

17. A method according to claim 13, including:

causing light from said second light source to pass through a lens before reaching said surface; and selecting one of a fluorescent fiber and a light emitting diode to serve as said second light source.

* * * * *